US006421960B1

(12) United States Patent
Manzella

(10) Patent No.: US 6,421,960 B1
(45) Date of Patent: Jul. 23, 2002

(54) SAFETY-LOCK FOR MULTI-POSITION TILT AND TURN WINDOW

(76) Inventor: Francis Manzella, 412 Woodbridge Rd., Rockville Centre, NY (US) 11570

( * ) Notice: Subject to any disclaimer, the term of this patent is extended or adjusted under 35 U.S.C. 154(b) by 0 days.

(21) Appl. No.: 09/526,918

(22) Filed: Mar. 16, 2000

(51) Int. Cl.[7] ..... E05D 15/52
(52) U.S. Cl. ..... 49/192; 49/394; 49/382
(58) Field of Search ..... 49/192, 394, 382

(56) References Cited

U.S. PATENT DOCUMENTS

| | | | | | |
|---|---|---|---|---|---|
| 2,869,486 | A | * | 1/1959 | Scites | 109/63.5 |
| 3,004,304 | A | * | 10/1961 | Frank | 49/192 |
| 3,667,162 | A | * | 6/1972 | Lalague | 49/192 |
| 3,911,621 | A | | 10/1975 | McHeffey | |
| 4,059,924 | A | * | 11/1977 | Bierlich | 49/192 |
| 4,074,462 | A | | 2/1978 | McHeffey | |
| 4,339,844 | A | * | 7/1982 | Shatters | 16/82 |
| 4,339,892 | A | | 7/1982 | Ulbricht et al. | |
| 4,602,457 | A | * | 7/1986 | Kreusel | 49/192 |
| 4,624,075 | A | | 11/1986 | Vigreux | |
| 4,811,518 | A | * | 3/1989 | Ladisa | 49/193 |
| 5,076,015 | A | * | 12/1991 | Manzalini | 49/192 |
| 5,226,256 | A | * | 7/1993 | Fries et al. | 49/13 |
| 5,615,522 | A | * | 4/1997 | Tomanek | 52/72 |
| 5,881,498 | A | | 3/1999 | Goggin et al. | |
| 6,062,368 | A | * | 5/2000 | Kamm | 193/31 A |

* cited by examiner

*Primary Examiner*—Gregory J. Strimbu
(74) *Attorney, Agent, or Firm*—Hoffmann & Baron, LLP

(57) ABSTRACT

A safety-lock mechanism for use with a multi-position window having a stationary window frame, a sash window frame positioned within the stationary window frame and selectively pivotable out of the stationary window frame about a vertical axis and a horizontal axis, and a drive train positioned between the sash window frame and the stationary window frame, the drive train being moveable between at least a first position which enables the sash window frame to be pivoted about the horizontal axis and a second position which enables the sash window frame to be pivoted about the vertical axis. The safety-lock mechanism includes a spring-biased pin provided on the sash window frame. The pin has a proximal end, a distal end, a locked position and an unlocked position, and is normally biased into the locked position. An aperture is provided within the drive train and is configured to receive the proximal end of the pin. In the locked position, the proximal end of the pin extends into the aperture so as to prevent movement of the drive train from the first position into the second position. When the pin is placed in the unlocked position, the drive train is capable of being moved from the first position into the second position, thereby allowing the sash window frame to be pivoted about the vertical axis.

26 Claims, 15 Drawing Sheets

SAFETY-LOCK FOR MULTI-POSITION TILT AND TURN WINDOW

BACKGROUND OF THE INVENTION

1. Field of the Invention

The present invention relates to safety-locks for multi-position windows. More particularly, the present invention relates to safety-locks for multi-position windows which prevent the window from pivoting about a vertical axis until the safety-lock is in the unlocked position.

2. Description of the Prior Art

There are many designs for security locks for multi-position windows or French windows. One lock design has a housing externally mounted on the lower horizontal portion of the moveable sash frame at the end that is distal from the vertical hinge axis and a catch externally mounted on the vertical portion of the stationary frame adjacent the housing. The housing contains a key operated bolt which slides along a horizontal axis normal to the horizontal portion of the sash frame. In the locked position, the bolt extends into an opening in the catch. In the unlocked position, the bolt is slid out of the opening within the catch.

In the locked position, the bolt in the opening prevents the sash from rotating about the vertical axis out of the stationary window frame. In order to be able to rotate the window sash about the vertical axis, the lock must be unlocked. Further, in order to be able to rotate the window sash about the horizontal axis, the lock must be placed at the sash horizontal axis. If the lock is placed in any other location along the sash frame, the lock must be unlocked in order to rotate the window sash about either the vertical axis or horizontal axis.

U.S. Pat. No. 3,911,621 describes a tilt and turn window having a drive train around three sides of the sash. The drive train is moved linearly by a three-position handle. Movement of the drive train switches the sash from a lockdown position in the window frame, to a position enabling rotation of the window frame on a vertical axis and finally, to a position enabling rotation out of the window frame on a horizontal axis.

When the handle is moved upwardly from center position the drive train is moved counterclockwise, thereby setting the window sash for rotation out of the window frame on the horizontal axis. When the handle is moved downward from the center position, the drive train moves clockwise setting the window sash for rotation out of the window frame on the vertical axis.

A key operated lock mechanism having a finger that is rotated by the key is installed just past the clockwise end of the drive train and positioned such that the finger can be turned to a position so as to interfere with the movement of the drive train, thereby preventing placement of the handle in a position which allows rotation of the window sash on the vertical axis. To allow placement of the handle into a position which allows rotation of the window sash about the vertical axis, the key must first be inserted into the lock, and then the finger must be turned to a position where it will not interfere with the movement of the drive train.

There are many drawbacks to this locking arrangement. First, a separate key is required to turn the lock from the locked position to the unlocked position. If one were to misplace the key, the lock would not be usable. Further, since the lock does not normally assume the locked position, then it can be kept in the unlocked position at all times, thereby defeating the purpose of having a lock altogether.

U.S. Pat. No. 4,074,462 describes a tilt and turn window having a drive train similar to the one described in his U.S. Pat. No. 3,911,621. A key operated lock mechanism is mounted on the frame of the sash. The lock includes a latch which extends into a longitudinal slot located in the drive train so that one end of the slot urges against the latch and prevents movement of the drive train into a position which will allow the sash to rotate out of the window frame on the vertical axis. Rotation of the latch out of the longitudinal slot with the key permits the drive train to move into position which will allow the sash to rot out of the window on the vertical axis.

The drawbacks to this locking arrangement are similar to that of U.S. Pat. No. 3,911,621. Namely, a separate key is required to turn the lock from the locked position to the unlocked position, and if one were to misplace that key, the lock would not be usable. Additionally, since the lock does not normally assume the locked position, it can be kept in the unlocked position at all times, thereby defeating the purpose of having a lock altogether.

U.S. Pat. No. 5,881,498 describes a multi-position window having a locking mechanism which allows rotation of the sash out of the window about the horizontal axis and prevents rotation of the sash about the vertical axis until the lock is in the unlocked position. The locking mechanism includes a bolt and a strike configured to receive the bolt. The locking mechanism further includes a hole in the sash frame which aligns with the bolt and the strike when the drive train is in a position which enables the sash to rotate about the vertical axis. The sash, even though in position to rotate about the vertical axis, cannot rotate about that axis until the lock is unlocked. In order to unlock the locking mechanism, a key is inserted into the hole in the sash. The key moves the bolt out of engagement with the strike, and thereby allows the window to rotate about the vertical axis. Similar to the previous locking mechanisms, a key is required to unlock the sash. If this key were misplaced, one would not be able to open the window.

OBJECTS AND SUMMARY OF THE INVENTION

One object of the present invention is to provide a safety-lock for a multi-position window which remains in the locked position so as to prevent rotation about the vertical axis while not interfering with the pivoting of the sash about the horizontal axis.

Another object of the present invention is to provide a safety-lock for a multi-position window which does not require a key for operation of the lock.

Another object of the present invention is to provide safety-lock for a multi-position window which will automatically be placed in the locked position when the sash is returned into the stationary window frame after rotation about the vertical axis.

Other objects and advantages of the present invention will be apparent from the following description of the invention.

In accordance with the present invention, a safety-lock mechanism for use with a multi-position window having a stationary window frame, a sash window frame positioned within the stationary window frame and selectively pivotable out of the stationary window frame about a vertical axis and a horizontal axis, and a drive train positioned between the sash window frame and the stationary window frame, the drive train being moveable between at least a first position which enables the sash window frame to be pivoted about the horizontal axis and a second position which enables the sash window frame to be pivoted about the vertical axis. The safety-lock mechanism includes a spring-biased pin provided on the sash window frame. The pin has a proximal end, a distal end, a locked position and an unlocked position, and is normally biased in the locked position. An aperture is provided within the drive train and is configured to receive the proximal end of the pin. In the locked position, the proximal end of the pin extends into the aperture so as to prevent movement of the drive train from the first position into the second position. When the pin is placed in the unlocked position, the drive train is capable of being moved from the first position into the second position, thereby allowing the sash window frame to be pivoted about the vertical axis.

BRIEF DESCRIPTION OF THE DRAWINGS

Further objects and features of the present invention will be better understood in light of the embodiment examples which are discussed below with the aid of a drawing wherein.

DESCRIPTION OF THE PREFERRED EMBODIMENTS

The present invention is a safety-lock which is designed to be operated in conjunction with a drive train of a multi-position window, such as a tilt and turn, or a tilt before turn window. As is typical with this style window, the drive train is mounted on the sash frame and extends around one or more edges of the sash frame. A handle is provided on the sash frame wherein rotation of handle causes linear movement of the drive train. Depending upon the position of the handle, the drive train is positioned so as to allow the sash window frame to pivot about a horizontal axis or a vertical axis.

Designs for drive trains for multi-position windows are well known in the art, and need not be described in detail in this disclosure. Drive trains for multi-position windows are described, for example, in U.S. Pat. Nos. 3,911,621, 4,074,462, 4,339,892 and 4,624,075, which are all incorporated herein by reference. It will be evident to one of skill in the art, given the following detailed description, of the modifications required to adapt the safety-lock of the present invention for use with any drive train for a multi-position window.

Figure 1:
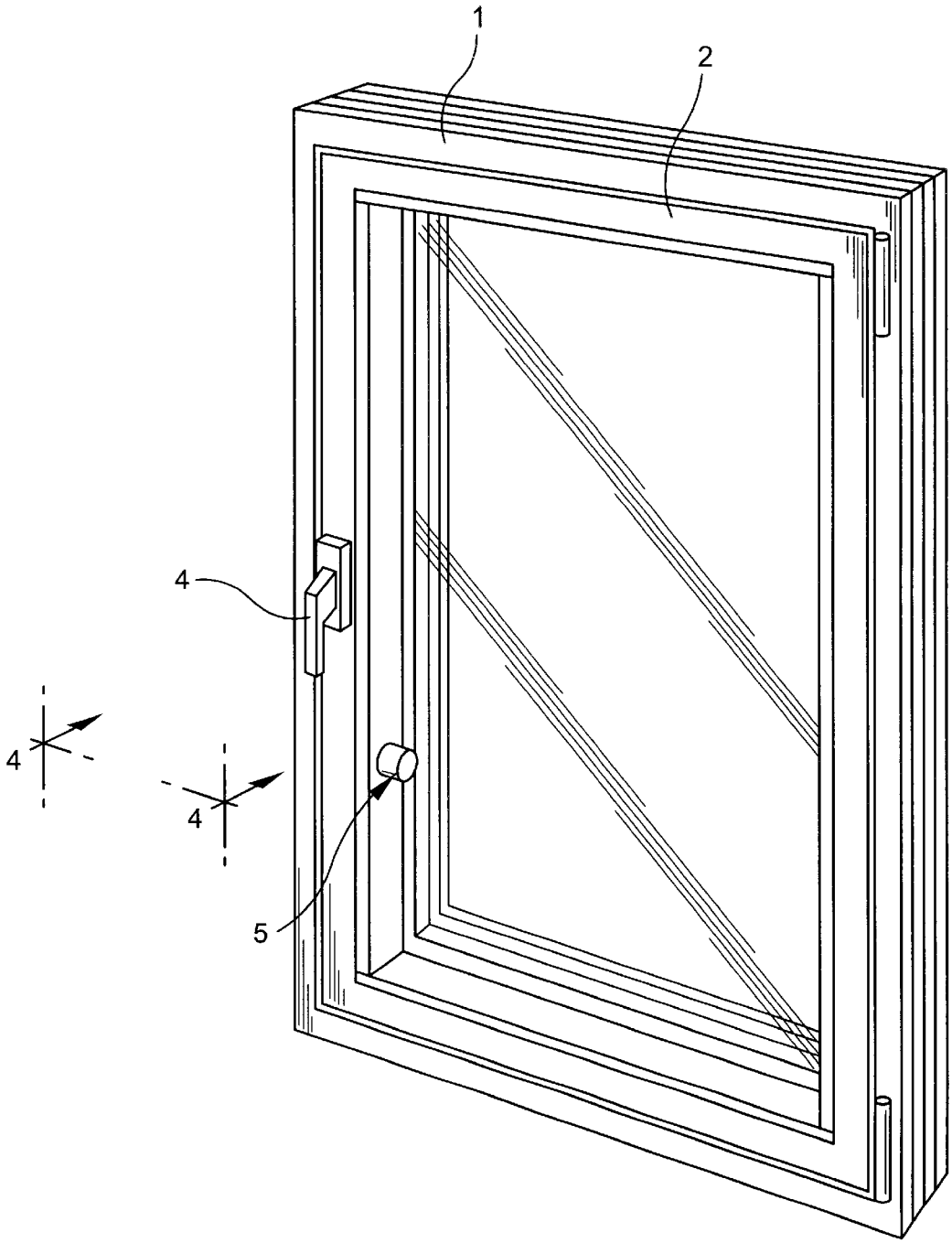
FIG. 1 is a front perspective view of the multi-position window of the present invention in the closed position.
Figure 2:
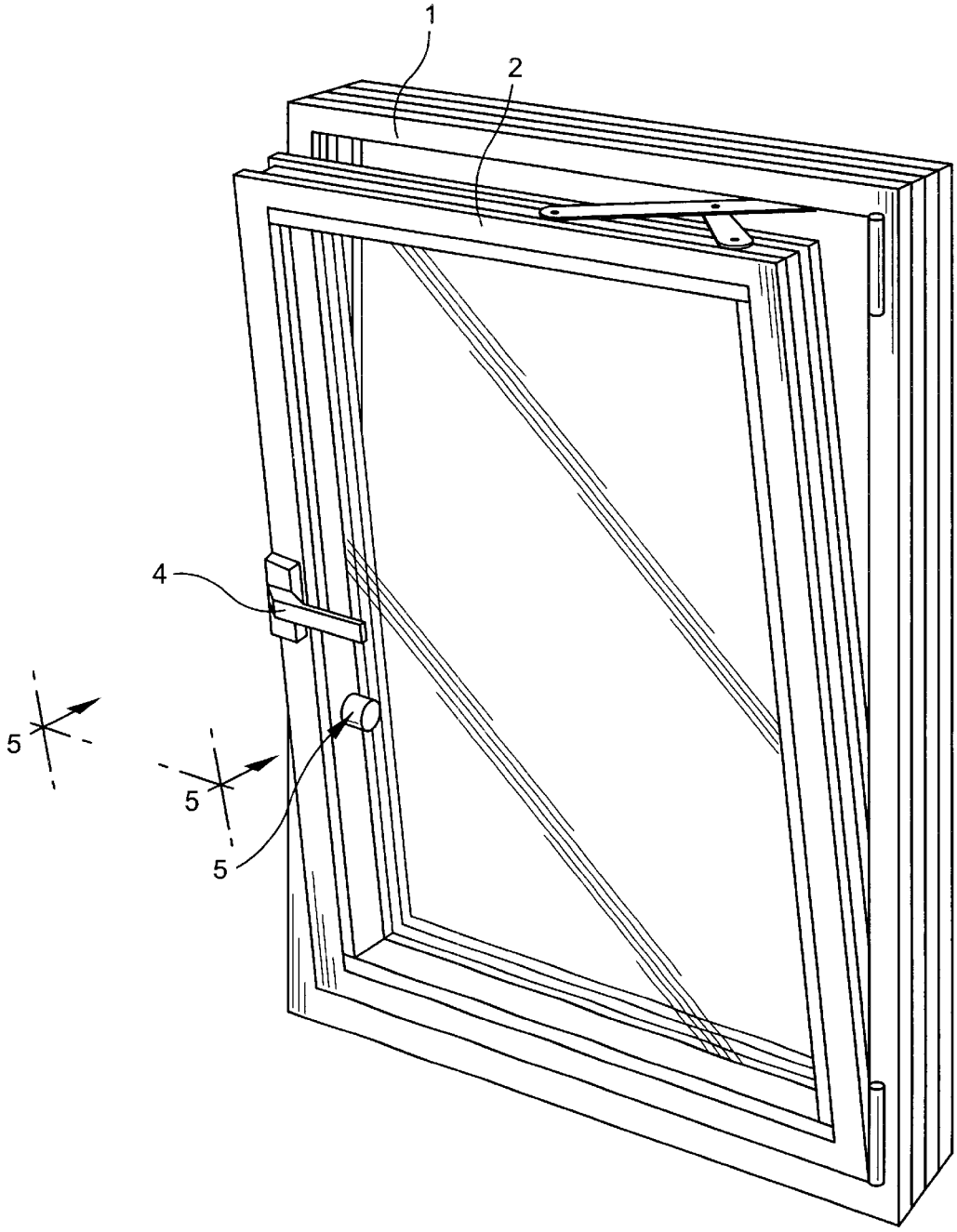
FIG. 2 is a front perspective view of the multi-position window of the present invention in the tilt-in position.
Figure 3:
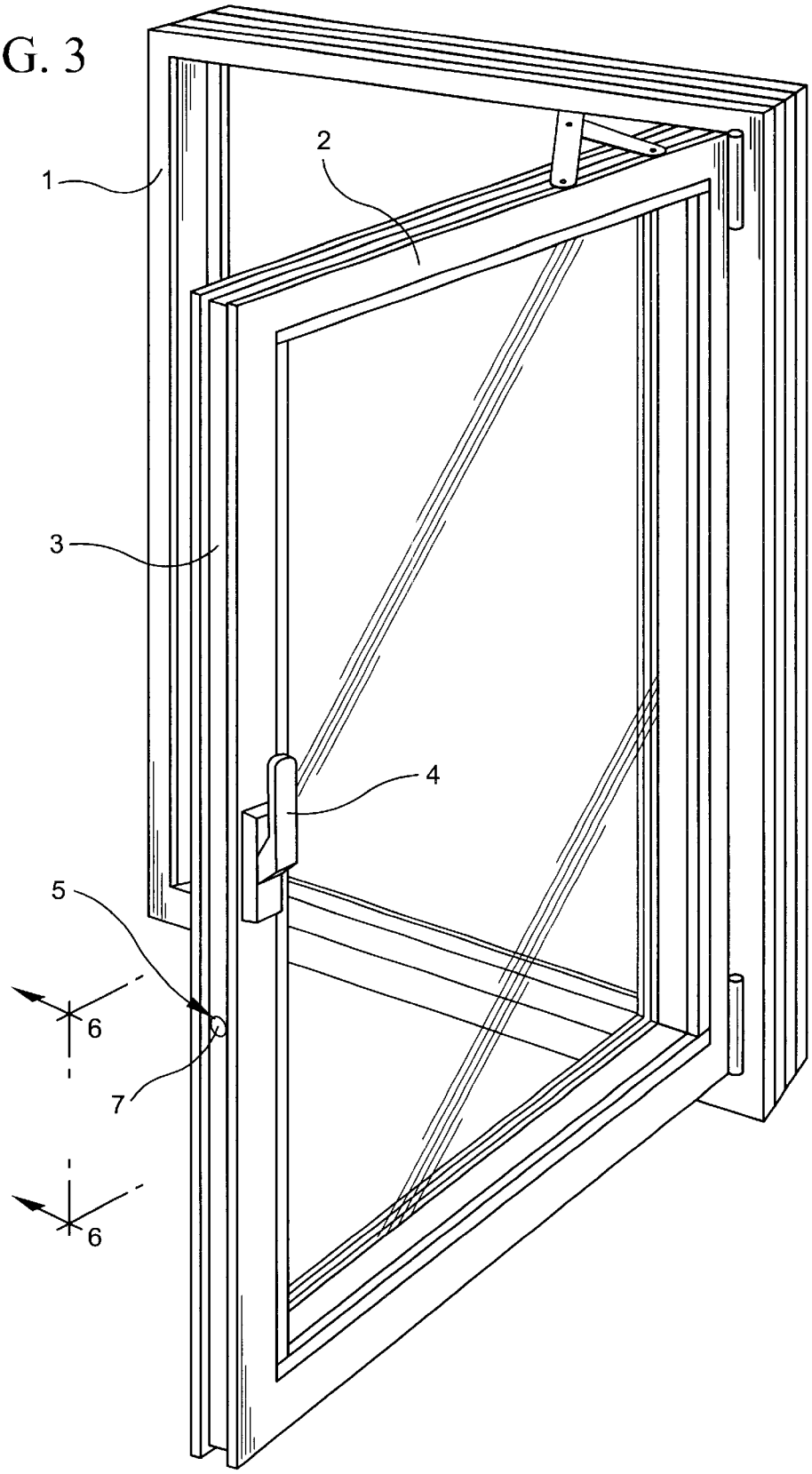
FIG. 3 is a front perspective view of the multi-position window of the present invention in the swing-in position.

Referring now to the drawings, FIGS. 1–7 show one embodiment of the multi-position window safety-lock of the present invention. As shown in FIGS. 1–3, the multi-position window includes a stationary window frame 1 and a sash window frame 2 positioned within the stationary window frame 1. As with multi-position windows, the sash window frame 2 is selectively pivotable out of the stationary window frame 1 about a horizontal axis (tilt-in), as shown in FIG. 2, and a vertical axis (swing-in), as shown in FIG. 3.

As shown n FIGS. 3–6, a drive train 3 is positioned between the sash window frame 2 and the stationary window frame 1. The drive train 3 is selectively moveable between at least a first position which enables the sash window frame 2 to be pivoted about the horizontal axis, and a second position which enables the sash window frame 2 to be pivoted about the vertical axis.

Preferably, and as is shown in FIGS. 1–7, the drive train 3 is designed to be selectively moveable between three positions. Placing the drive train 3 in the first position prevents the sash window frame from being pivoted about the horizontal axis and the vertical axis, thereby placing the window in a closed position as shown in FIG. 1. In other words, the first position "locks-down" the sash window frame 2 and prevents any and all movement out of the stationary window frame 1. Placing the drive train 3 in the second position, as shown in FIG. 2, enables the sash window frame 2 to be pivoted about the horizontal axis (tilt-in). Placing the drive train 3 in the third position, as shown in FIG. 3, enables the sash window frame 2 to be pivoted about the vertical axis (swing-in).

In order to facilitate movement of the drive train 3, the sash window frame 2 is provided with a handle 4. The handle 4 is rotatably mounted on the sash window frame 2 so as to communicate with the drive train 3 such that the relative rotation of the handle 4 causes movement of the drive train 3 from one position to the next, i.e., from the first position into the second position, from the second position into the third position, from the third position into the second position, or from the second position into the first position. As described above, the mechanism used to facilitate movement of the drive train in relation to the handle are known in the art and need not be discussed in detail herein.

Figure 5:
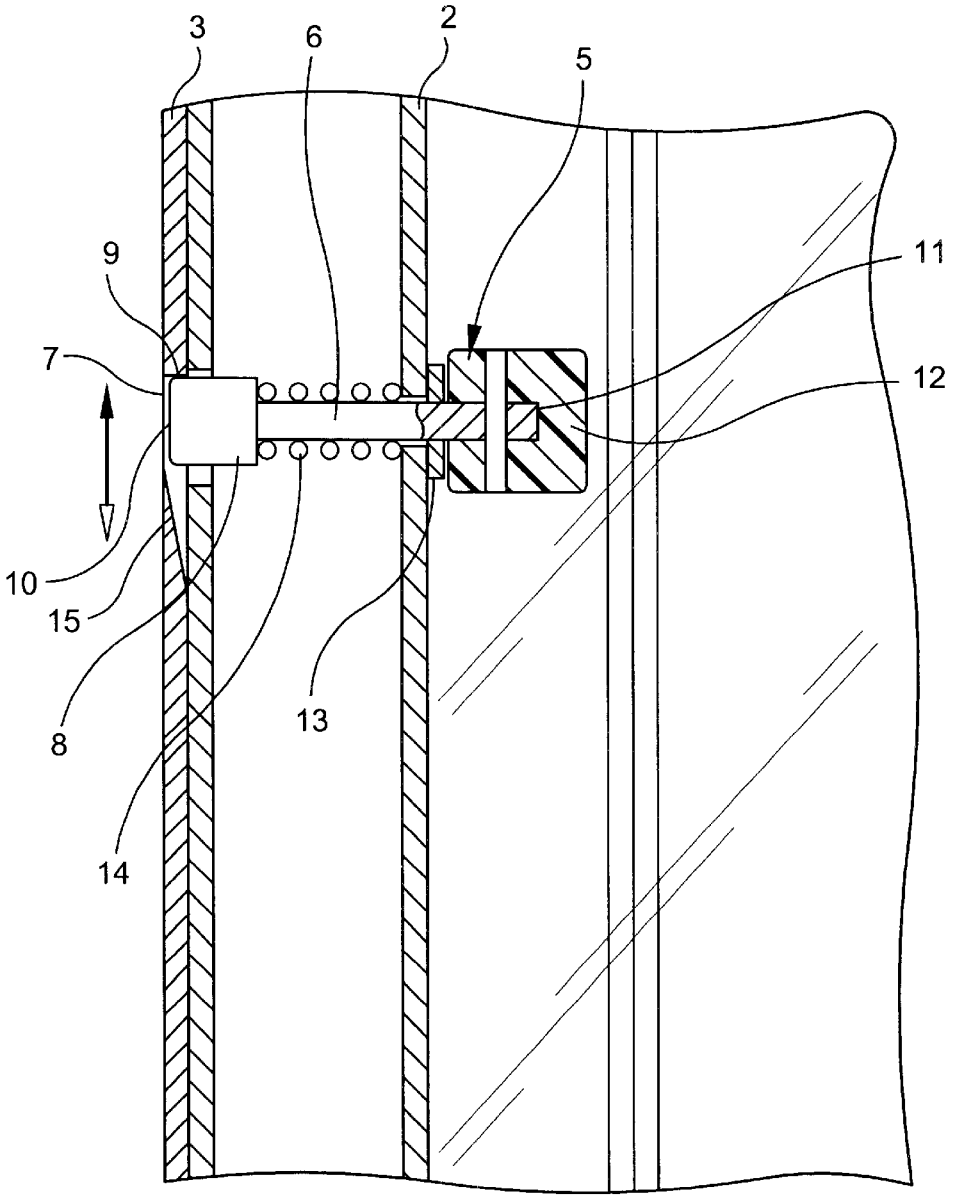
FIG. 5 is a cross-sectional view of the safety-lock of the present invention along line 5—5 of FIG. 2.

A safety-lock mechanism, generally referred to as 5, is arranged on the sash window frame 2 and the drive train 3. The safety-lock mechanism 5 includes a spring-biased pin 6 having a proximal end 10 and a distal end 11, and an aperture 7 positioned on the drive train 3 and configured to receive the proximal end 10 of the pin 6. The spring-biased pin 6 has a locked position, shown in FIG. 5, and an unlocked position, shown in FIG. 6. The pin 6 is normally biased in the locked position wherein the proximal end 10 of the pin 6 extends into the aperture 7. Preferably, when the lock is in the locked position, the proximal end 10 of the pin 6 is positioned within the aperture 7 so as to not interfere with the closing of the sash 2 within the window 1. In other words, the proximal end 10 of the pin 6 does not extend through the aperture 7, but rather is positioned within the aperture 7. To position the pin 6 in such a manner, the pin 6 is provided with a stop 13. The stop 13, as shown in FIG. 5, is urged against the sash frame 2 by the spring 14. The relative placement of the stop 13 along the length of the pin 6 will determine the degree to which the proximal end 10 of the pin 6 sits within the aperture 7 in the locked position.

Figure 6:
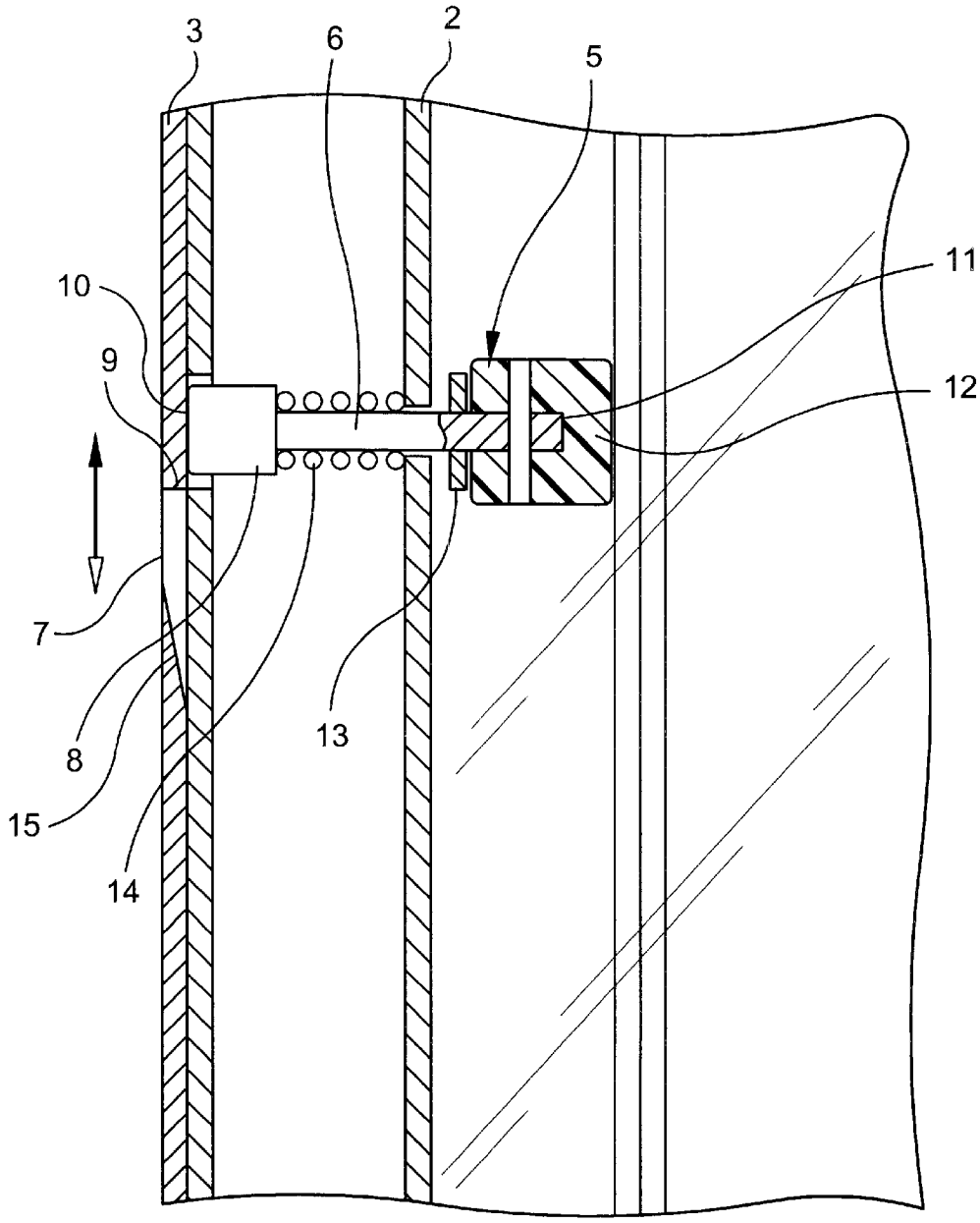
FIG. 6 is a cross-sectional view of the safety-lock of the present invention along line 6—6 of FIG. 3.

In the locked position, the proximal end 10 of the pin 6 and the aperture 7 cooperate to prevent movement of the drive train 3 from the tilt-in position into the swing-in position. As can be seen with reference to FIG. 5, the outer surface 8 of the proximal end 10 of the pin 6 engages the inner surface 9 of the aperture 7 so as to prevent movement of the drive train 3. The drive train 3 is moved from the tilt-in position into the swing-in position by placing the pin 6 in the unlocked position, as shown in FIG. 6. In order to place the pin 6 in the unlocked position, the distal end 11 of the pin 6 is provided with a grip 12 which enables the user to retract the proximal end 10 of the pin 6 toward the sash frame 2 and out of the aperture 7. With the proximal end 10 of the pin 6 out of the aperture 7, the drive train 3 can be moved into the swing-in position by the relative rotation of the handle.

Figure 4:
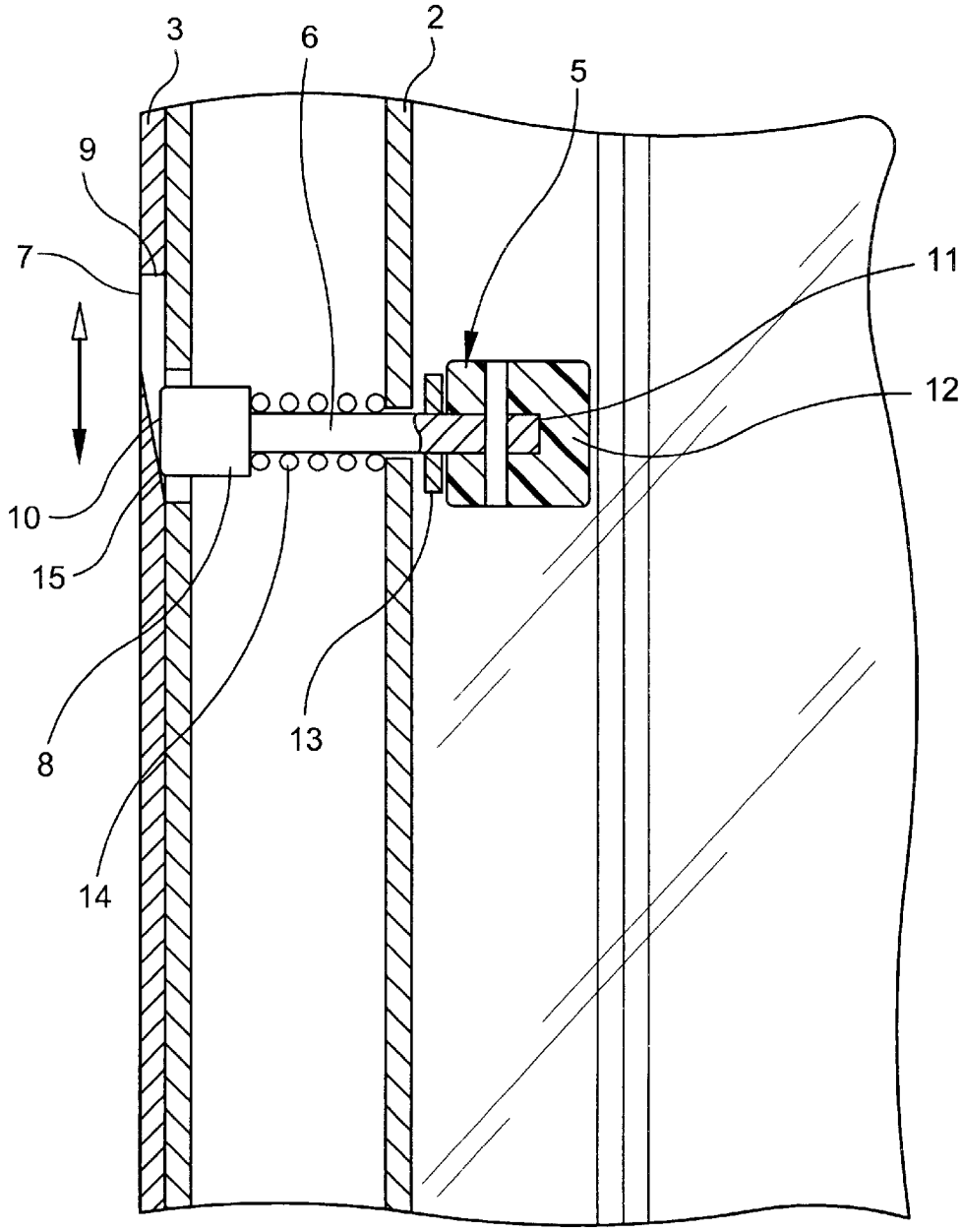
FIG. 4 is a cross-sectional view of the safety-lock of the present invention along line 4—4 of FIG. 1.
Figure 7:
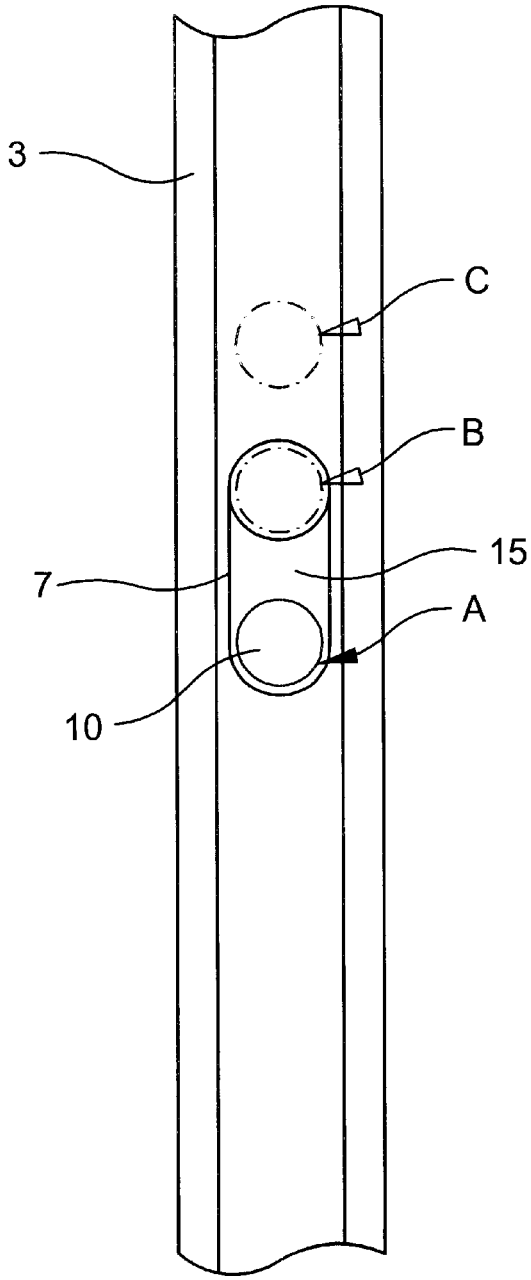
FIG. 7 is a front elevation view of the drive train of FIGS. 4–6.

With the embodiment shown in FIGS. 1–7, the aperture 7 is provided with a ramp 15 at one end thereof. The ramp 15 enables the movement of the drive train 3 from the closed position into the tilt-in position without the need to place the safety-lock in the unlocked position. As shown in FIGS. 4–5, the proximal end 10 of the pin 6 rides up the ramp 15 when the drive train 3 is moved from the closed position into the tilt-in position and down the ramp 15 when the drive train 3 is moved from the tilt-in position into the closed position. FIG. 7 shows the relative position of the proximal end 10 of the pin 6, aperture 7, ramp 15 and drive train 3 when the sash window frame 2 is in the closed position A, tilt-in position B and the swing-in position C.

Figure 9:
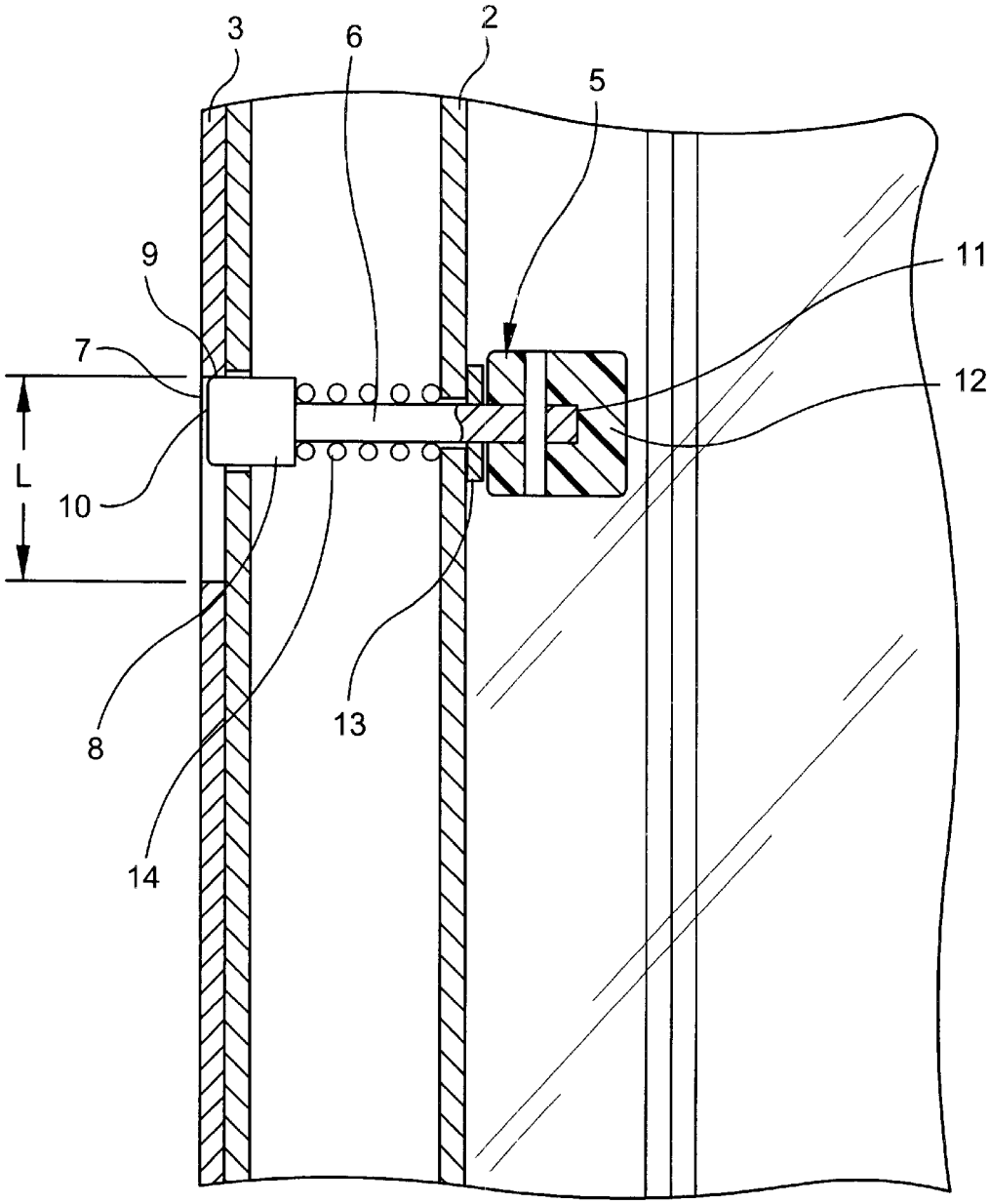
FIG. 9 is a cross-sectional view of the safety-lock of FIG. 8 with the multi-position window is in the tilt-in position.
Figure 10:
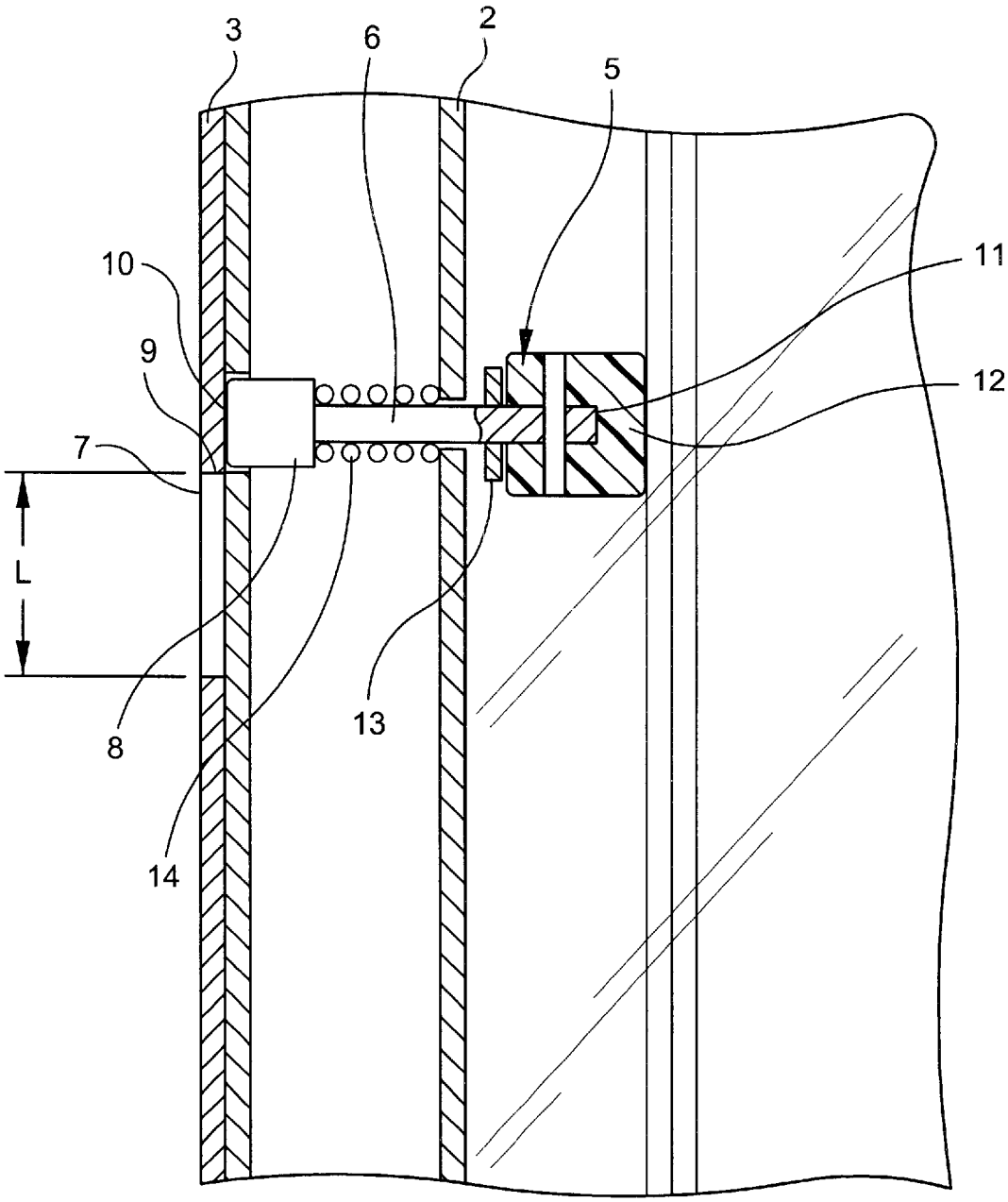
FIG. 10 is a cross-sectional view of the safety-lock of FIG. 8 with the safety-lock in the unlocked position.
Figure 11:
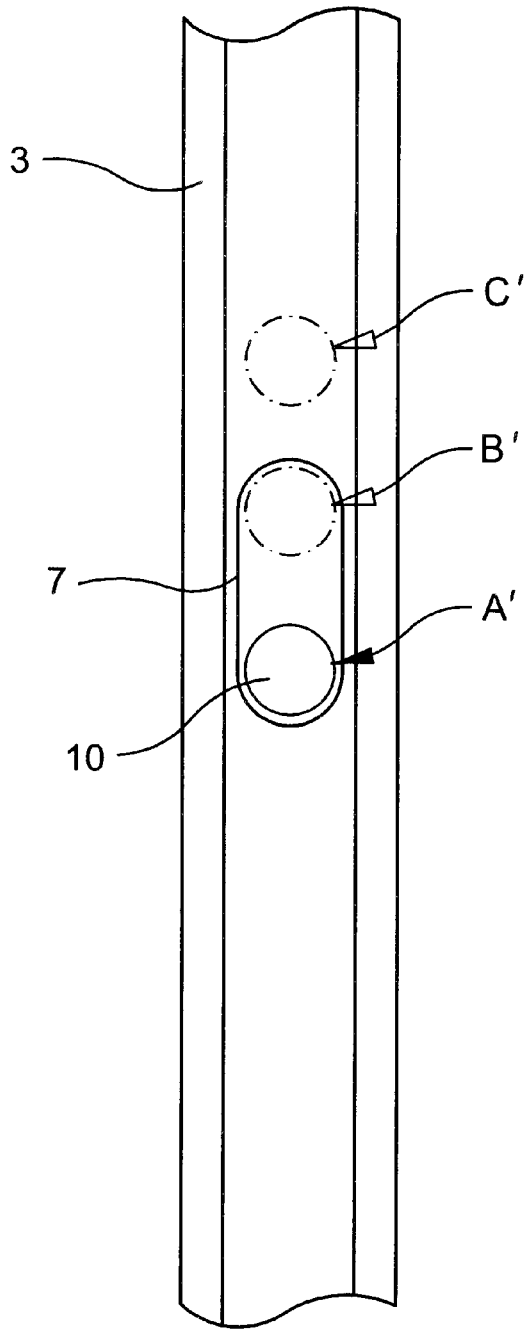
FIG. 11 is a front elevation view of the drive train of FIGS. 8–10.

An alternate embodiment of the safety-lock mechanism, generally referred to as 5, is shown in FIGS. 8–11. Similar to the embodiment shown in FIGS. 1–7, the safety-lock mechanism 5 includes a spring-biased pin 6 having a proximal end 10 and a distal end 11, and an aperture 7*a* positioned on the drive train 3 and configured to receive the proximal end 10 of the pin 6. The spring-biased pin 6 has a locked position, shown in FIG. 9, and an unlocked position, shown in FIG. 10. The pin 6 is normally biased into the locked position wherein the proximal end 10 of the pin 6 extends into the aperture 7*a*. With this embodiment, the aperture 7*a* is designed as an elongate slot having a length L sufficient to enable movement of the drive train 3 from the closed position into the tilt-in position and from the tilt-in position into the closed position without interference with the proximal end 10 of the pin 6. This allows the sash window frame 2 to be easily placed from the closed position into the tilt-in position while at the same time preventing movement from the tilt-in position into the swing-in position until the safety-lock is placed in the unlocked position. FIG. 11 shows the relative position of the proximal end 10 of the pin 6, elongate slot 7*a* and drive train 3 when the sash window frame 2 is in the closed position A', tilt-in position B' and the swing-in position C'.

Figure 8:
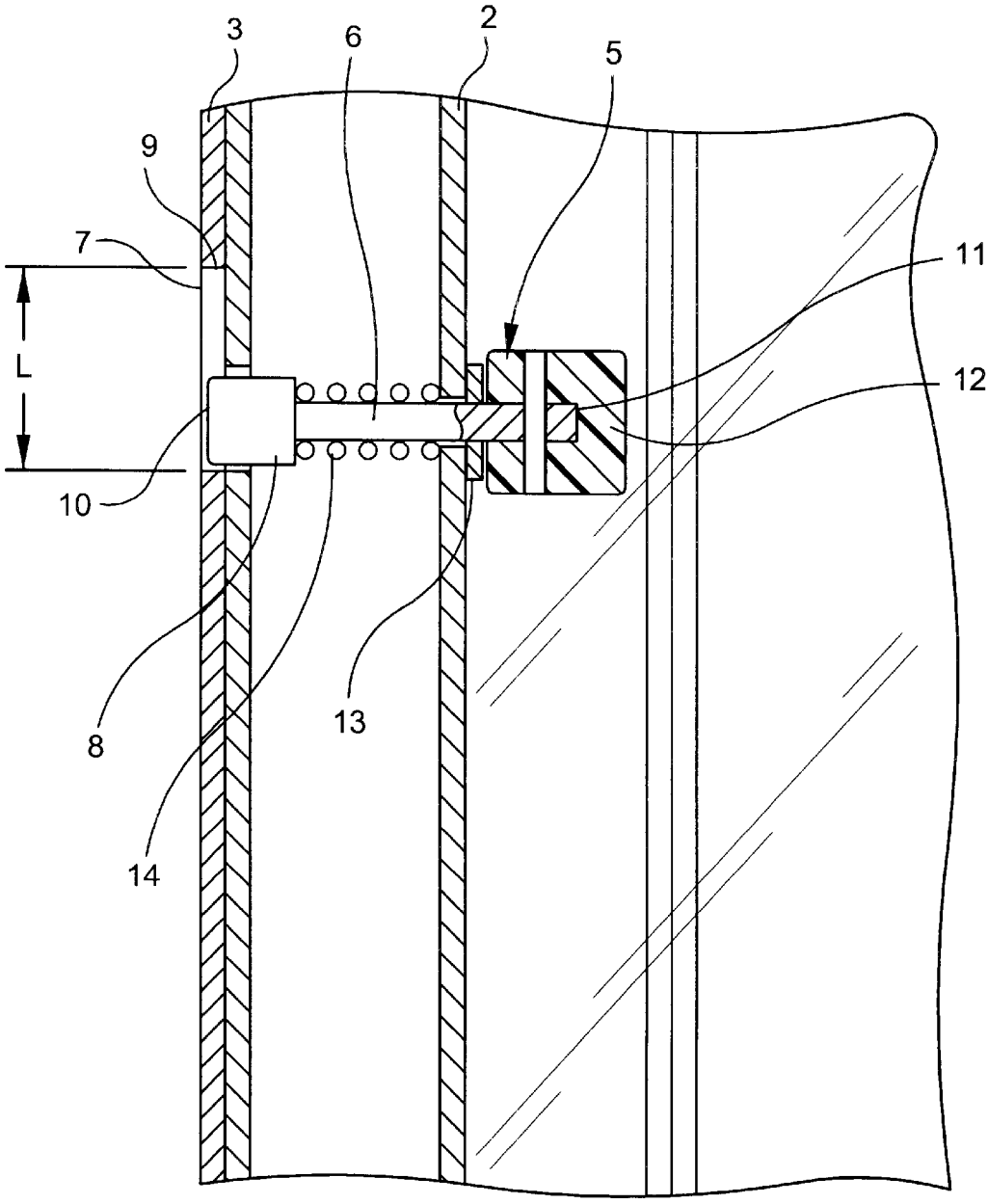
FIG. 8 is a cross-sectional view of a further embodiment of the safety-lock of the present invention along line 4—4 of FIG. 1.

Similar to the embodiment shown in FIGS. 1–7, when the safety-lock 5 is in the locked position, the proximal end 10 of the pin 6 is positioned within the elongate slot 7*a* so as to not interfere with the closing of the sash 2 within the window. In other words, the proximal end 10 of the pin 6 does not extend through the elongate slot 7*a*, but rather is positioned within the elongate slot 7*a*. To position the pin 6 in such a manner, the pin 6 is provided with a stop 13. The stop 13, as shown in FIGS. 8–9, is urged against the sash frame 2 by the spring 14. The relative placement of the stop 13 along the length of the pin 6 will determine the degree to which the proximal end 10 of the pin 6 sits within the elongate slot 7*a* in the locked position.

In the locked position, the proximal end 10 of the pin 6 and the elongate slot 7*a* cooperate to prevent movement of the drive train 3 from the tilt-in position into the swing-in position. As can be seen with reference to FIG. 9, the outer surface 8 of the proximal end 10 of the pin 6 engages the inner surface 9 of the elongate slot 7*a* so as to prevent movement of the drive train 3. The drive train 3 is moved from the tilt-in position into the swing-in position by placing the pin 6 in the unlocked position, as shown in FIG. 10. In order to place the pin 6 in the unlocked position, the distal end 11 of the pin 6 is provided with a grip 12 which enables the user to retract the proximal end 10 of the pin 6 toward the sash frame 2 and out of the elongate slot 7*a*. With the proximal end 10 of the pin 6 out of the elongate slot 7*a*, the drive train 3 can be moved into the swing-in position by the relative rotation of the handle.

Figure 12:
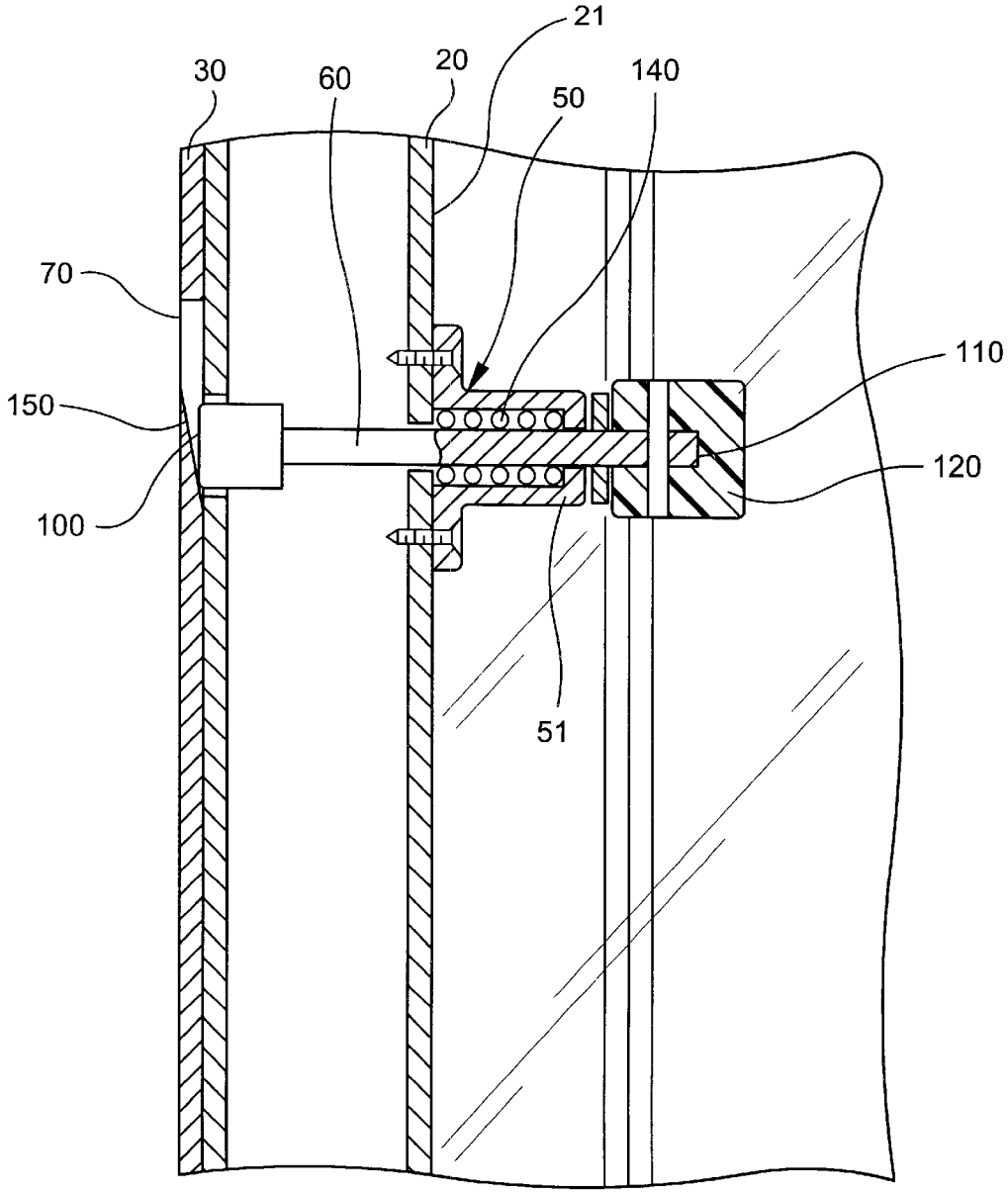
FIG. 12 is a cross-sectional view of an additional embodiment of the safety-lock of the present invention.

In a further embodiment, as shown in FIG. 12, the safety-lock mechanism, generally referred to as 50, is positioned on the window-side edge 21 of the sash frame 20. The safety-lock mechanism 50 includes a housing 51 attached to the sash window frame 20 and an elongate bar 60 having a proximal end 100 and a distal end 110. The elongate bar 60 is spring-biased by a spring 140 for linear movement into and out of an aperture 70 within the drive train 30. When the safety-lock 50 is in the locked position, the proximal end 100 of the elongate bar 60 is positioned within the aperture 70 so as to not interfere with the closing of the sash window frame 20 within the window. In other words, the elongate bar 60 does not extend through the aperture 70, but rather is positioned within the aperture 70.

To position the elongate bar 60 in such a manner, the elongate bar 60 is provided with a stop 130. The stop 130, as shown in FIG. 12, is urged against the housing 51 by the spring 140. The relative placement of the stop 130 along the length of the elongate bar 60 will determine the degree to which the proximal end 100 of the elongate bar 60 sits within the aperture 70 in the locked position.

As with the previously described embodiments, the proximal end 100 of the elongate bar 60 and the aperture 70 cooperate to prevent movement of the drive train 30 from the tilt-in position into the swing-in position. The drive train 30 is moved from the tilt-in position into the swing-in position by placing the elongate bar 60 in the unlocked position. In order to place the elongate bar 60 in the unlocked position, the distal end 110 of the elongate bar 60 is provided with a grip 120 which enables the user to retract the proximal end 100 of the elongate bar 60 toward the sash frame 20 and out of the aperture 70. With the proximal end 100 out of the aperture 70, the drive train 30 can be moved into the swing-in position by the relative rotation of the handle.

As with the embodiments shown in FIGS. 1–11, the aperture 70 can be provided with a ramp 150 at one end thereof (as shown in FIG. 12), or the aperture 70 can be designed as an elongate slot having a length sufficient to enable movement of the drive train 30 from the closed position into the tilt-in position and from the tilt-in position into the closed position without interference with the proximal end 100 of the elongate bar 60. The use of either an elongate slot or a ramp, and the function of each, has been fully described in detail with reference to FIGS. 1–7.

Figure 13:
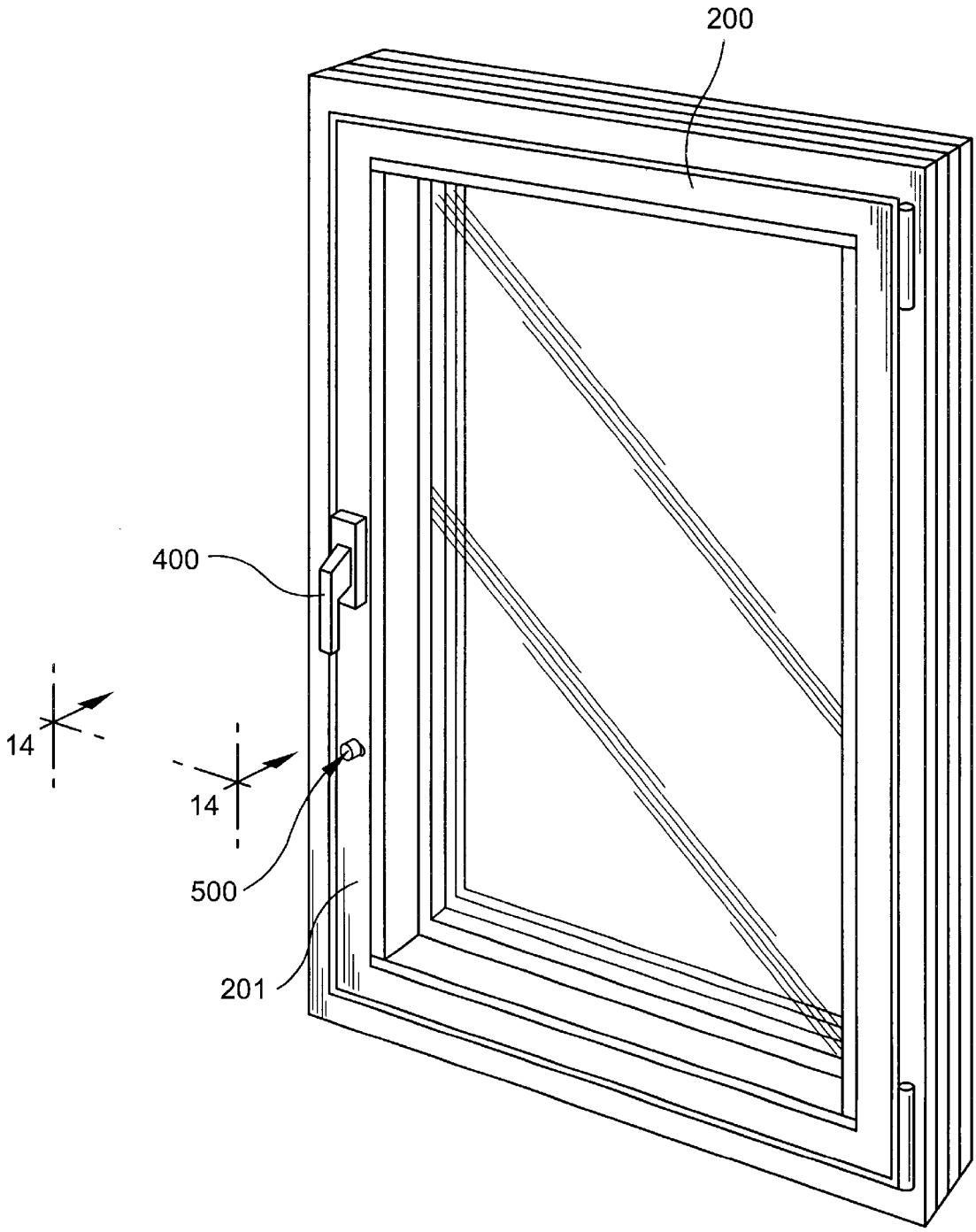
FIG. 13 is a front perspective view of a yet another embodiment of the multi-position window of the present invention in the closed position.
Figure 14:
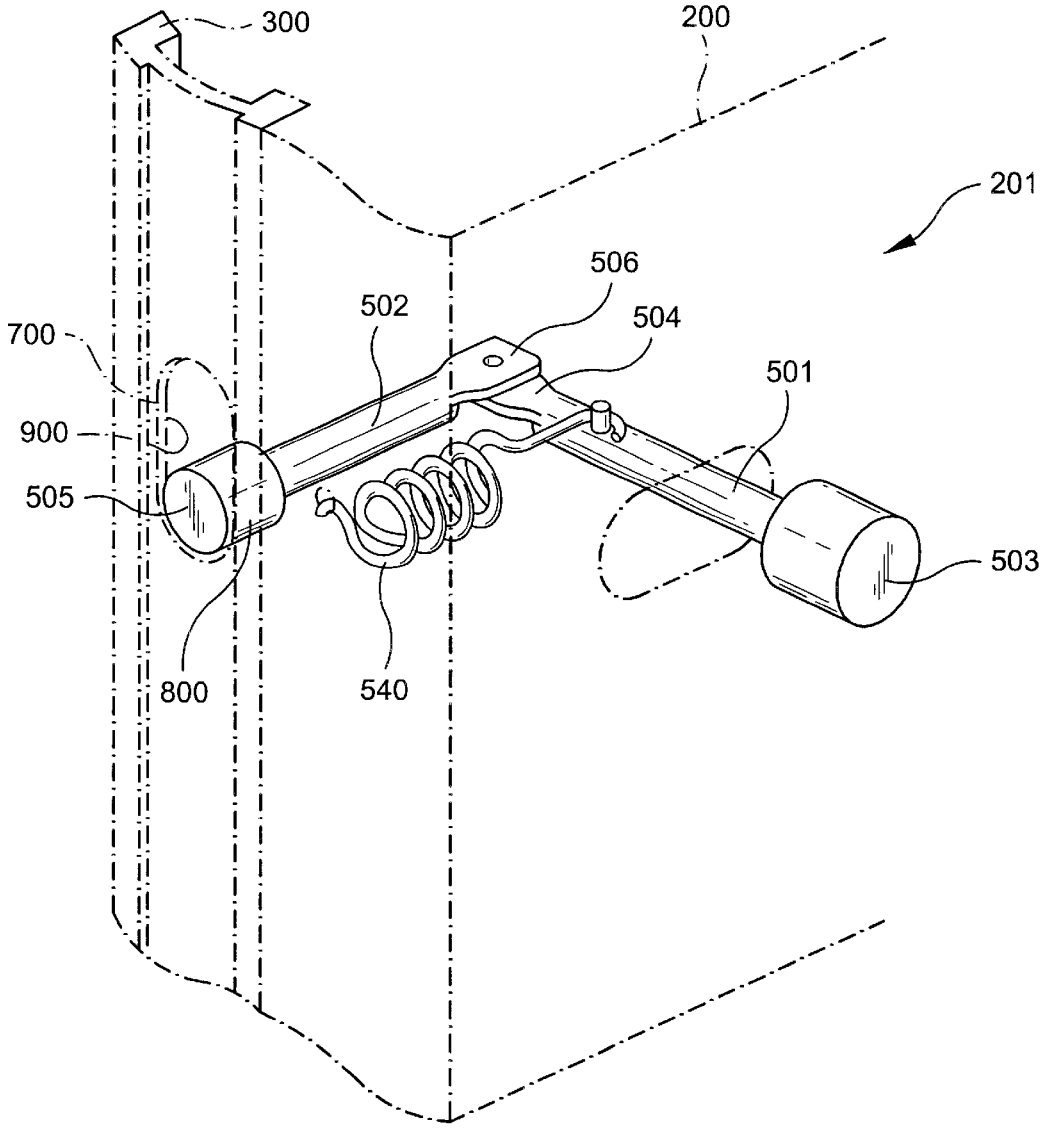
FIG. 14 is a perspective detailed view of the safety-lock of the FIG. 13 in the locked position and wherein the sash window frame and the drive train are shown in broken lines.
Figure 15:
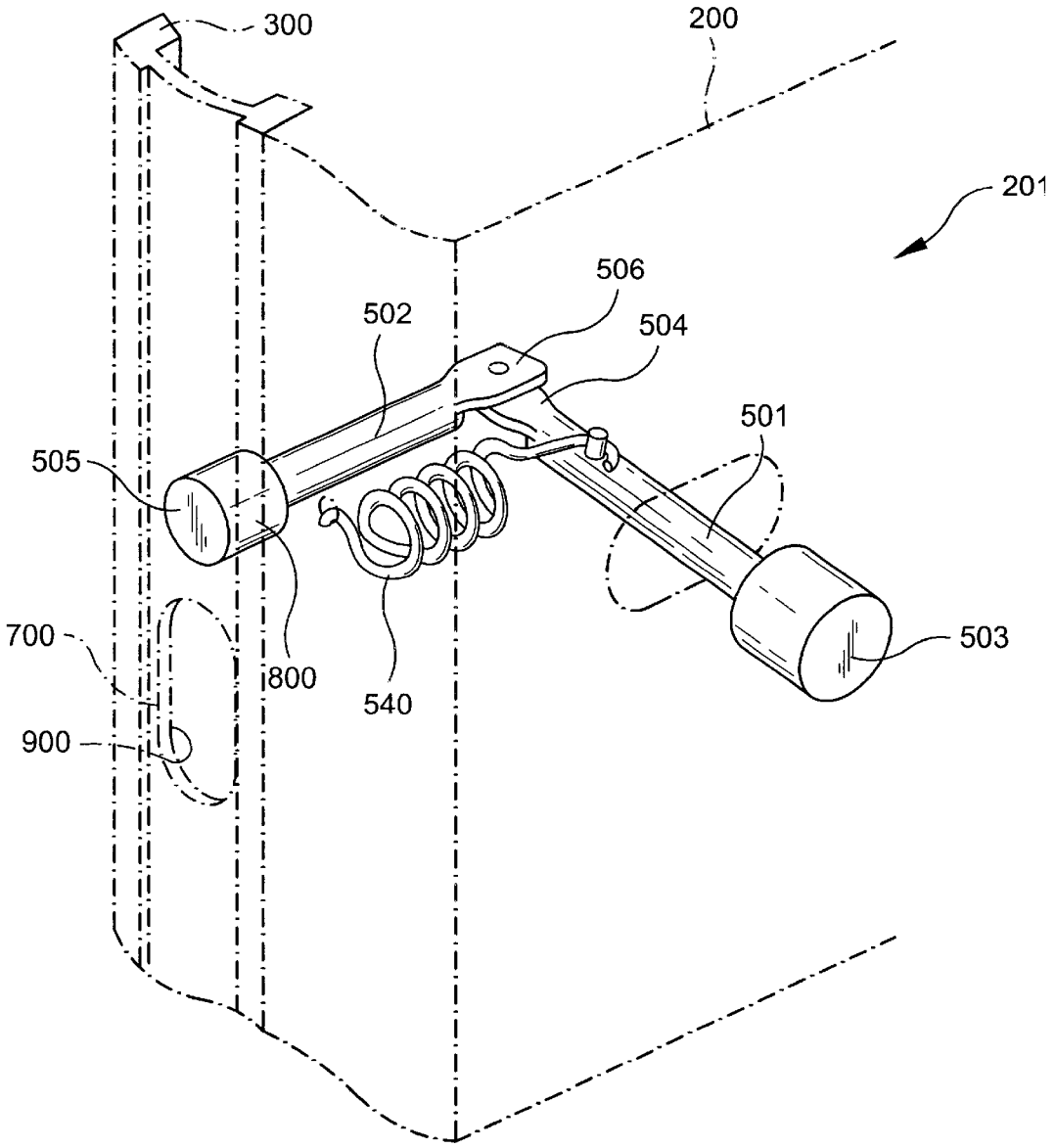
FIG. 15 is a perspective detailed view of the safety-lock of the FIG. 13 in the unlocked position and wherein the sash window frame and the drive train are shown in broken lines.

In still a further embodiment, as shown in FIGS. 13–15, the safety-lock mechanism, generally referred to as 500, is positioned so as to be operable from the face 201 of the window sash frame 200 proximal to the handle 400. The safety-lock mechanism 500 includes a first actuation-bar 501 having a proximal end 503 and a distal end 504 and a second lock-bar 502 having a proximal end 505 and a distal end 506. The first actuation-bar 501 and the second actuation-bar 502 are pivotally attached to one another at their respective distal ends 504, 506 such that the proximal end 503 of the first actuation-bar 501 extends through the face 201 of the sash 200 to provide a toggle for unlocking the safety-lock. In order to enable the first actuation-bar 501 to be toggled, the first actuation-bar 501 is provided with a fulcrum 510. The fulcrum 510 is positioned along the length of the first actuation-bar 501 so as to provide a pivot point about which the first actuation-bar 501 pivots. Further, and as is readily apparent from FIGS. 14 and 15, the placement of the fulcrum 510 along the length of the first actuation-bar 501 will be such that the spring 540 is capable of biasing the second lock-bar 502 into the locked position. The fulcrum 510 will further be secured to the sash window frame 200 in a manner which will allow the first actuation-bar 501 to be toggled. Securing the fulcrum 510 to the sash window frame 200 can be accomplished, for example, by providing a rib 511 within the sash window frame 200 to which the fulcrum 510 is secured.

The second lock-bar 502 is spring-biased by the spring 540 for linear movement into and out of the aperture 700 within the drive train 300 in response to the toggling of the first actuation-bar 501. Preferably, when the safety-lock is in the locked position, the proximal end 505 of the lock-bar 502 is positioned within the aperture 700 so as to not interfere with the closing of the sash 200 within the window. In other words, the proximal end 505 of the lock-bar 502 does not extend through the aperture 700, but rather is positioned within the aperture 700.

In the locked position, the proximal end 505 of the lock bar 502 and the aperture 700 cooperate to prevent movement of the drive train 300 from the tilt-in position into the swing-in position. As can be seen with reference to FIG. 14, the outer surface 800 of the proximal end 505 of the lock-bar 502 engages the inner surface 900 of the aperture 700 so as to prevent movement of the drive train 300. The drive train 300 is moved from the tilt-in position into the swing-in position by toggling the actuation-bar 501 into the unlocked position, as shown in FIG. 15. With the proximal end 505 of the lock-bar 502 out of the aperture 700, the drive train 300 can be moved into the swing-in position by the relative rotation of the handle.

With the embodiment shown in FIGS. 14 and 15, the aperture 700 is shown having a length L' sufficient to enable movement of the drive train 300 from the closed position into the tilt-in position and from the tilt-in position into the closed position without interference with the proximal end 505 of the lock-bar 502. The aperture, however, can be provided with a ramp at one end thereof. The use of either an elongate slot or a ramp, and the function of each, has been fully described in detail with reference to FIGS. 1–7.

There are many advantages to the safety-lock of the present invention. First, the present invention does not require a key to operate the lock. The keyless operation of the present lock does not allow someone to keep the lock in the unlocked position, and thereby avoids the potential problems with children, in particular, inadvertently opening the window and creating a dangerous situation. Further, not using a key also resolves the problem of losing the key and not being able to unlock the lock to place the window in the swing-in position.

Additionally, the use of a spring-biased lock provides a degree of child resistance in that, in order to place the window in the swing-in position, the lock must be placed in the unlocked position and the drive train must be moved to the swing-in position. The use of these two separate motions to place the window in the swing-in position provides a measure of difficulty for small children.

Further, the spring-biasing of the lock into the locked position automatically locks the lock when the sash is returned from the swing-in position into the tilt-in position. Unlike other multi-position window locks, this automatic locking is accomplished without the need for a separate step of locking the lock via the turning of a key.

Thus, while the foregoing detailed description has disclosed what is presently believed to be the preferred embodiments of the invention, those skilled in the art will appreciate that other and further changes and modifications can be made without departing from the scope or spirit of the invention, and it is intended that all such other changes and modifications are included in and are within the scope of the invention as described in the appended claims.

What is claimed is:

1. A multi-position window comprising:

a stationary window frame;

a sash window frame positioned within said stationary window frame, said sash window frame being selectively pivotable out of said stationary window frame about one of a vertical axis and a horizontal axis;

a drive train positioned between said sash window frame and said stationary window frame, said drive train being moveable between a first position, a second position and a closed position, said first position enabling said sash window frame to be pivoted about said horizontal axis, said second position enabling said sash window frame to be pivoted about said vertical axis and said closed position preventing pivoting of said sash window frame out of said stationary window frame; and a safety-lock mechanism provided on said sash window frame, said safety-lock mechanism including:

a spring-biased pin having a proximal end and a distal end, said pin having a locked position and an unlocked position; and an aperture within said drive train, said aperture configured to receive said proximal end of said pin;

wherein said proximal end of said pin extends into said aperture when in said locked position so as to prevent movement of said drive train from said first position into said second position, and wherein said pin in said unlocked position allows said movement of said drive train from said first position into said second position; and wherein said aperture is an elongate slot, said elongate slot having a length sufficient to enable movement of said drive train between said closed position and said first position so as to allow said sash window frame to be pivoted about said horizontal axis without said pin moving into said unlocked position.

2. A multi-position window as claimed in claim 1 further including a handle rotatably mounted on said sash window frame, wherein rotation of said handle causes movement of said drive train between said first position and said second position.

3. A multi-position window as claimed in claim 1 wherein said proximal end of said pin is positioned within said aperture so as to not interfere with a closing of said sash window frame within said stationary window frame when said pin is in said locked position.

4. A multi-position window as claimed in claim 3 wherein said pin is provided with a stop, and wherein placement of said stop on said pin determines an amount said proximal end of said pin extends into said aperture in said locked position.

5. A multi-position window as claimed in claim 1 wherein said distal end of said pin is provided with a grip which enables retracting said pin out of said aperture and into said unlocked position.

6. A multi-position window comprising:

a stationary window frame;

a sash window frame positioned within said stationary window frame, said sash window frame being selectively pivotable out of said stationary window frame about one of a vertical axis and a horizontal axis;

a drive train positioned between said sash window frame and said stationary window frame, said drive train being moveable between a first position, a second position and a closed position, said first position enabling said sash window frame to be pivoted about said horizontal axis, said second position enabling said sash window frame to be pivoted about said vertical axis and said closed position preventing pivoting of said sash window frame out of said stationary window frame; and a safety-lock mechanism provided on said sash window frame, said safety-lock mechanism including:

a pin having a proximal end and a distal end, said pin having a locked position and an unlocked position; and an aperture within said drive train, said aperture configured to receive said proximal end of said pin;

wherein said proximal end of said pin extends into said aperture when in said locked position so as to prevent movement of said drive train from said first position into said second position, and wherein said pin in said unlocked position allows said movement of said drive train from said first position into said second position; and wherein said drive train is provided with a ramp disposed adjacent to the aperture, said ramp enabling movement of said drive train between said closed position and said first position so as to allow said sash window frame to be pivoted about said horizontal axis without said pin moving into said unlocked position.

7. A multi-position window as claimed in claim 6 wherein said proximal end of said pin is positioned within said aperture so as to not interfere with a closing of said sash window frame within said stationary window frame when said pin is in said locked position.

8. A multi-position window as claimed in claim 7 wherein said pin is provided with a stop, and wherein placement of said stop on said pin determines an amount said proximal end of said pin extends into said aperture in said locked position.

9. A multi-position window as claimed in claim 6 wherein said distal end of said pin is provided with a grip which enables retracting said pin out of said aperture and into said unlocked position.

10. A multi-position window as claimed in claim 6 further including a handle rotatably mounted on said sash window frame, wherein rotation of said handle causes movement of said drive train between said first position and said second position.

11. A multi-position window comprising:

a stationary window frame;

a sash window frame positioned within said stationary window frame, said sash window frame being selectively pivotable out of said stationary window frame about one of a vertical axis and a horizontal axis;

a drive train positioned between said sash window frame and said stationary window frame, said drive train being moveable between a first position and a second position, said first position enabling said sash window frame to be pivoted about said horizontal axis and said second position enabling said sash window frame to be pivoted about said vertical axis; and a safety-lock mechanism provided on said sash window frame, said safety-lock mechanism including:

an aperture within said drive train;

a first actuation-bar having a proximal end and a distal end; and a second actuation-bar having a proximal end and a distal end;

said first actuation-bar and said second actuation-bar being pivotally attached to one another at their respective distal ends such that the proximal end of said first actuation-bar extends through said sash window frame to provide a toggle for unlocking the safety-lock mechanism; and said second actuation-bar being spring-biased and capable of moving into and out of said aperture in response to toggling of said first actuation-bar.

12. A multi-position window as claimed in claim 11 further including a handle rotatably mounted on said sash window frame, wherein rotation of said handle causes movement of said drive train between said first position and said second position.

13. A multi-position window as claimed in claim 11 wherein said proximal end of said second actuation-bar is positioned within said aperture so as to not interfere with a closing of said sash window frame within said stationary window frame.

14. A multi-position window comprising:

a stationary window frame;

a sash window frame positioned within said stationary window frame, said sash window frame being selectively pivotable out of said stationary window frame about one of a vertical axis and a horizontal axis;

a drive train positioned between said sash window frame and said stationary window frame, said drive train being moveable between a first position, a second position and a third position, said first position preventing said sash window frame from being pivoted out of said stationary window frame, said second position enabling said sash window frame to be pivoted about said horizontal axis, and said third position enabling said sash window frame to be pivoted about said vertical axis; and a locking mechanism provided on said sash window frame, said locking mechanism including:

a spring-biased pin, said pin having a locked position and an unlocked position and configured to be spring-biased into said locked position; and an aperture within said drive train, said aperture configured to receive a proximal end of said pin;

wherein said pin extends into said aperture when in said locked position so as to prevent movement of said drive train from said second position into said third position, and wherein said pin in said unlocked position allows said movement of said drive train from said second position into said third position and;

wherein said aperture is an elongate slot, said elongate slot having a length sufficient to enable movement of said drive train between said first position and said second position so as to allow said sash window frame to be pivoted about said horizontal axis without said pin moving into said unlocked position.

15. A multi-position window as claimed in claim 14 further including a handle rotatably mounted on said sash window frame, wherein rotation of said handle causes movement of said drive train between said second position and said third position.

16. A multi-position window as claimed in claim 14 wherein said pin is positioned within said aperture so as to not interfere with a closing of said sash window frame within said station window frame when said pin in said locked position.

17. A multi-position window as claimed in claim 16 wherein said pin is provided with a stop, and wherein placement of said stop on said pin determines an amount said pin extends into said aperture in said locked position.

18. A multi-position window as claimed in claim 14 wherein said pin is provided with a grip which enables retracting said pin out of said aperture and into said unlocked position.

19. A multi-position window comprising:

a stationary window frame;

a sash window frame positioned within said stationary window frame, said sash window frame being selectively pivotable out of said stationary window frame about one of a vertical axis and a horizontal axis;

a drive train positioned between said sash window frame and said stationary window frame, said drive train being moveable between a first position, a second position and a third position, said first position preventing said sash window frame from being pivoted out of said stationary window frame, said second position enabling said sash window frame to be pivoted about said horizontal axis, and said third position enabling said sash window frame to be pivoted about said vertical axis; and a locking mechanism provided on said sash window frame, said locking mechanism including:

a pin, said pin having a locked position and an unlocked position and configured to be spring-biased into said locked position; and an aperture within said drive train, said aperture configured to receive a proximal end of said pin;

wherein said pin extends into said aperture when in said locked position so as to prevent movement of said drive train from said second position into said third position, and wherein said pin in said unlocked position allows said movement of said drive train from said second position into said third position and;

wherein said drive train is provided with a ramp disposed adjacent to the aperture, said ramp enabling movement of said drive train between said first position and said second position so as to allow said sash window frame to be pivoted about said horizontal axis without said pin moving into said unlocked position.

20. A multi-position window as claimed in claim 19 wherein said pin is positioned within said aperture so as to not interfere with a closing of said sash window frame within said stationary window frame when said pin is in said locked position.

21. A multi-position window as claimed in claim 20 wherein said pin is provided with a stop, and wherein placement of said stop on said pin determines an amount said pin extends into said aperture in said locked position.

22. A multi-position window as claimed in claim 19 wherein said pin is provided with a grip which enables retracting said pin out of said aperture and into said unlocked position.

23. A multi-position window as claimed in claim 19 further including a handle rotatably mounted on said sash window frame, wherein rotation of said handle causes movement of said drive train between said second position and said third position.

24. A multi-position window comprising:

a stationary window frame;

a sash window frame positioned within said stationary window frame, said sash window frame being selectively pivotable out of said stationary window frame about one of a vertical axis and a horizontal axis;

a drive train positioned between said sash window frame and said stationary window frame, said drive train being moveable between a first position, a second position and a third position, said first position preventing said sash window frame from being pivoted out of said stationary window frame, said second position enabling said sash window frame to be pivoted about said horizontal axis, and said third position enabling said sash window frame to be pivoted about said vertical axis; and a locking mechanism provided on said sash window frame, said locking mechanism including:

an elongate slot within said drive train, said elongate slot having a length sufficient to enable movement of said drive train between said first position and said second position so as to allow said sash window frame to be pivoted about said horizontal axis;

a first actuation-bar having a proximal end and a distal end; and a second actuation-bar having a proximal end and a distal end;

said first actuation-bar and said second actuation-bar being pivotally attached to one another at their respective distal ends such that the proximal end of said first actuation-bar extends through said sash window frame to provide a toggle for unlocking the locking mechanism; and said second actuation-bar being spring-biased and adapted to move into and out of said elongate slot in response to toggling of said first actuation-bar.

25. A multi-position window as claimed in claim 24 further including a handle rotatably mounted on said sash window frame, wherein rotation of said handle causes movement of said drive train between said second position and said third position.

26. A multi-position window as claimed in claim 24 wherein said proximal end of said second actuation-bar is positioned within said slot so as to not interfere with a closing of said sash window frame within said stationary window frame.

* * * * *